US007207269B2

(12) United States Patent
Yoshida

(10) Patent No.: US 7,207,269 B2
(45) Date of Patent: Apr. 24, 2007

(54) COATING MATERIAL APPLYING METHOD AND COATING MATERIAL APPLYING APPARATUS FOR APPLYING A COATING MATERIAL TO SURFACES OF PRINTS, AND A PRINTING MACHINE HAVING THE COATING MATERIAL APPLYING APPARATUS

(75) Inventor: Takumi Yoshida, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 12 days.

(21) Appl. No.: 10/814,254

(22) Filed: Apr. 1, 2004

(65) Prior Publication Data

US 2004/0202794 A1 Oct. 14, 2004

(30) Foreign Application Priority Data

Apr. 11, 2003 (JP) ..... 2003-107390

(51) Int. Cl.
*B41N 3/00* (2006.01)

(52) U.S. Cl. ..... 101/463.1; 347/12; 118/314; 118/315

(58) Field of Classification Search ..... 101/463.1, 101/483–484, 490; 347/12, 13; 118/642, 118/305, 313–315; 427/256, 288, 421.1, 427/427.2

See application file for complete search history.

(56) References Cited

U.S. PATENT DOCUMENTS

| | | | | |
|---|---|---|---|---|
| 2,029,273 | A * | 1/1936 | Montgemery et al. | 101/483 |
| 2,868,166 | A * | 1/1959 | Brechenmacher | 118/643 |
| 4,748,046 | A * | 5/1988 | Kuboki et al. | 427/510 |
| 4,767,694 | A * | 8/1988 | Schubert | 430/300 |
| 5,438,350 | A * | 8/1995 | Kerry | 347/12 |
| 5,511,477 | A * | 4/1996 | Adler et al. | 101/401.1 |
| 5,513,567 | A * | 5/1996 | Froh et al. | 101/170 |
| 5,738,013 | A * | 4/1998 | Kellett | 101/463.1 |
| 5,820,932 | A * | 10/1998 | Hallman et al. | 427/261 |
| 6,083,571 | A * | 7/2000 | Kapfinger | 427/555 |
| 6,095,050 | A * | 8/2000 | Figov | 101/483 |
| 6,138,566 | A * | 10/2000 | Sakamoto | 101/463.1 |
| 6,254,230 | B1 | 7/2001 | Wen et al. | |
| 6,516,721 | B1 | 2/2003 | Voge | |
| 2002/0009547 | A1 | 1/2002 | Ito et al. | |

FOREIGN PATENT DOCUMENTS

| | | |
|---|---|---|
| EP | 0 389 252 A2 | 9/1990 |

(Continued)

*Primary Examiner*—Daniel J. Colilla
*Assistant Examiner*—Jill E. Culler
(74) *Attorney, Agent, or Firm*—McDermott Will & Emery LLP

(57) ABSTRACT

A coating material applying apparatus according to this invention includes a guide board, a droplet spray nozzle head, and an ultraviolet light emitting device. The guide board has numerous suction bores formed in a surface thereof and connected to a vacuum pump. The droplet spray nozzle head is disposed opposite the guide board, and has numerous droplet spray nozzles. The nozzles spray ultraviolet-curable varnish to printing paper transported toward a paper discharge station. The ultraviolet light emitting device is disposed opposite the guide board, and adjacent and downstream of the droplet spray nozzle head with respect to a direction of paper transport, for emitting ultraviolet light to the printing paper having the ultraviolet-curable varnish applied thereto.

11 Claims, 12 Drawing Sheets

FOREIGN PATENT DOCUMENTS

| | | | |
|---|---|---|---|
| EP | 0 782 106 | A2 | 7/1997 |
| EP | 0 867 279 | A1 | 9/1998 |
| GB | 1 235 704 | | 6/1971 |
| GB | 2 317 367 | A | 3/1998 |
| JP | 10-250187 | | 9/1998 |
| JP | 2001-199046 | A | 7/2001 |
| JP | 2002-200743 | A | 7/2002 |
| JP | 2002-361833 | A | 12/2002 |
| WO | WO 02/34542 | A1 | 5/2002 |

* cited by examiner

COATING MATERIAL APPLYING METHOD AND COATING MATERIAL APPLYING APPARATUS FOR APPLYING A COATING MATERIAL TO SURFACES OF PRINTS, AND A PRINTING MACHINE HAVING THE COATING MATERIAL APPLYING APPARATUS

BACKGROUND OF THE INVENTION

1. Field of the Invention

This invention relates to a coating material applying method, a coating material applying apparatus and a printing machine for applying a coating material such as varnish to surfaces of prints for surface protection and/or luster enhancement.

2. Description of the Related Art

A known printing machine for applying varnish as a coating material to surfaces of prints is described in Japanese Unexamined Patent Publication No. 2001-199046, for example. The printing machine described in this publication includes a varnish applying apparatus having a cylinder supported to be rotatable and defining a notch in a peripheral surface thereof, and an applicator roller supported to be rotatable for contacting and feeding varnish to the cylinder.

However, the above printing machine is constructed to apply varnish picked up from a varnish vessel to printing paper, through the applicator roller, and has a drawback of requiring a large apparatus for varnish application. Furthermore, with such an application mode, it is impossible to apply varnish only to a particular area on the printing paper, for example. When it is desired to apply varnish only to a particular area, a printing unit for one color and a printing plate therefor must be provided (Japanese Unexamined Patent Publication No. 1995-304160).

SUMMARY OF THE INVENTION

The object of this invention, therefore, is to provide a coating material applying method, a coating material applying apparatus and a printing machine which are simple in construction and yet are capable of applying a coating material to entire surfaces or only particular areas of prints.

The above object is fulfilled, according to this invention, by a coating material applying method for applying a coating material to a surface of a print, wherein the coating material is applied to the surface of the print by spraying the coating material thereto from a plurality of droplet spray nozzles.

With this coating material applying method, the coating material is applied to the surface of the print by spraying the coating material thereto from a plurality of droplet spray nozzles. This realizes a simplified apparatus.

In the coating material applying method in a preferred embodiment, an area for coating material application is determined as a particular area on the print, and the coating material is applied to the particular area by spraying the coating material selectively onto the particular area.

Preferably, the droplet spray nozzles are arranged transversely of the print, and the coating material is applied selectively to the particular area by driving only droplet spray nozzles corresponding to the particular area among the plurality of droplet spray nozzles.

The particular area may be determined based on image data forming an image on the print.

In another preferred embodiment, the coating material is an ultraviolet-curable coating material, and this coating material is cured by emitting ultraviolet light to the print after applying the coating material to the print.

In another aspect of this invention, a coating material applying apparatus is provided for applying a coating material to a surface of a print, the apparatus comprising a plurality of droplet spray nozzles for spraying the coating material on the surface of the print to apply the coating material thereto, and a moving device for moving the print relative to the droplet spray nozzles.

In a further aspect of the invention, a printing machine is provided for performing printing based on image data, which comprises a transport mechanism for transporting a print, a coating applying device including a plurality of droplet spray nozzles arranged perpendicular to a direction in which the print is transported by the transport mechanism, for spraying a coating material on the print transported, an area determining device for determining, based on the image data, an area for coating material application as a particular area on the print, and a control device for selecting droplet spray nozzles corresponding to the particular area from among the plurality of droplet spray nozzles, and causing the coating material to be sprayed from the droplet spray nozzles selected.

Other features and advantages of the invention will be apparent from the following detailed description of the embodiments of the invention.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

An embodiment of the invention will be described hereinafter with reference to the drawings.

Figure 1:
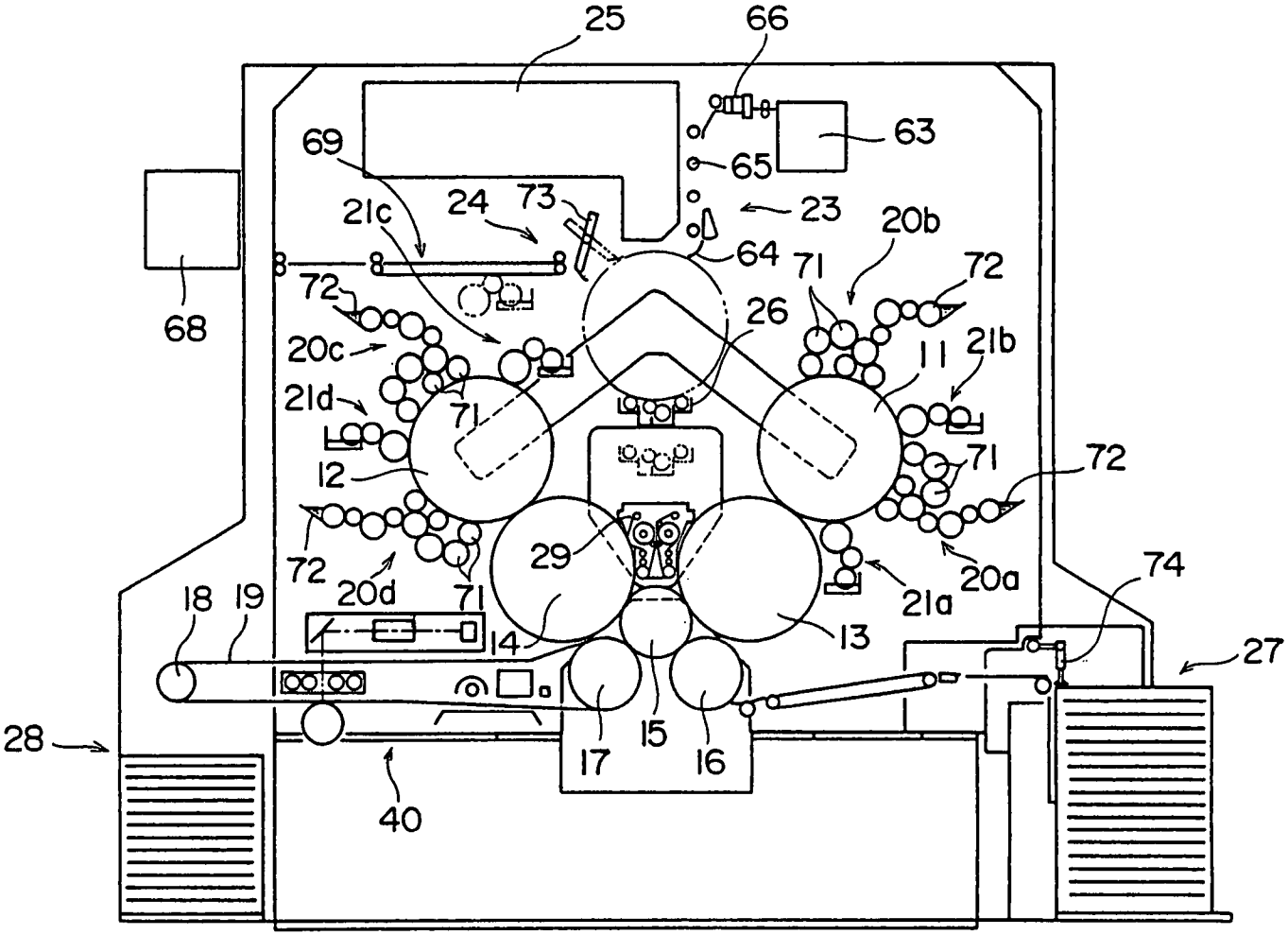
FIG. 1 is a schematic side view of a printing machine according to this invention.

A construction of a printing machine according to this invention will be described first. FIG. 1 is a schematic view of the printing machine according to this invention.

This printing machine records images on blank plates mounted on first and second plate cylinders 11 and 12, feeds inks to the plates having the images recorded thereon, and transfers the inks from the plates through first and second blanket cylinders 13 and 14 to printing paper held on an impression cylinder 15, thereby printing the images on the printing paper.

The first plate cylinder 11 is movable between a first printing position shown in a solid line and an image recording position shown in a two-dot chain line in FIG. 1. The second plate cylinder 12 is movable between a second printing position shown in a solid line in FIG. 1 and the same image recording position.

Around the first plate cylinder 11 in the first printing position are an ink feeder 20*a* for feeding an ink of black (K), for example, to the plate, an ink feeder 20*b* for feeding an ink of magenta (M), for example, to the plate, and dampening water feeders 21*a* and 21*b* for feeding dampening water to the plate. Around the second plate cylinder 12 in the second printing position are an ink feeder 20*c* for feeding an ink of cyan (C), for example, to the plate, an ink feeder 20*d* for feeding an ink of yellow (Y), for example, to the plate, and dampening water feeders 21*c* and 21*d* for feeding dampening water to the plate. Further, around the first or second plate cylinder 11 or 12 in the image recording position are a plate feeder 23, a plate remover 24, an image recorder 25 and a developing device 26.

The first blanket cylinder 13 is contactable with the first plate cylinder 11, while the second blanket cylinder 14 is contactable with the second plate cylinder 12. The impression cylinder 15 is contactable with the first and second blanket cylinders 13 and 14 in different positions. The machine further includes a paper feed cylinder 16 for transferring printing paper supplied from a paper storage 27 to the impression cylinder 15, a paper discharge cylinder 17 with chains 19 wound thereon for discharging printed paper from the impression cylinder 15 to a paper discharge station 28, a paper discharge mechanism 60 for transporting the printed paper to the paper discharge station 28, a droplet spray nozzle head 50 for spraying varnish to the printing paper transported by the paper discharge mechanism 60, an ultraviolet light emitting device 51 for emitting ultraviolet light to the varnish applied to the surface of the printing paper to cure the varnish, an image pickup device 40 for measuring color densities of detecting patches printed on the printing paper, and a blanket cleaning unit 29.

Each of the first and second plate cylinders 11 and 12 is coupled to a plate cylinder moving mechanism not shown, and driven by this moving mechanism to reciprocate between the first or second printing position and the image recording position. In the first printing position, the first plate cylinder 11 is driven by a motor not shown to rotate synchronously with the first blanket cylinder 13. In the second printing position, the second plate cylinder 12 is rotatable synchronously with the second blanket cylinder 14. Adjacent the image recording position is a plate cylinder rotating mechanism, not shown, for rotating the first or second plate cylinder 11 or 12 whichever is in the image recording position.

The plate feeder 23 and plate remover 24 are arranged around the first or second plate cylinder 11 or 12 in the image recording position.

The plate feeder 23 includes a supply cassette 63 storing a roll of elongate blank plate in light-shielded state, a guide member 64 and guide rollers 65 for guiding a forward end of the plate drawn from the cassette 63 to the surface of the first or second plate cylinder 11 or 12, and a cutter 66 for cutting the elongate plate into sheet plates. Each of the first and second plate cylinders 11 and 12 has a pair of clamping jaws, not shown, for clamping the forward and rear ends of the plate fed from the plate feeder 23.

The plate remover 24 has a blade mechanism 73 for separating a plate from the first or second plate cylinder 11 or 12 after a printing operation, a discharge cassette 68, and a conveyor mechanism 69 for transporting the plate separated by the blade mechanism 73 to the discharge cassette 68.

The forward end of the plate drawn from the feeder cassette 63 is guided by the guide rollers 65 and guide member 64, and clamped by one of the clamping jaws on the first or second plate cylinder 11 or 12. Then, the first or second plate cylinder 11 or 12 is rotated by the plate cylinder rotating mechanism not shown, whereby the plate is wrapped around the first or second plate cylinder 11 or 12. The rear end of the plate cut by the cutter 66 is clamped by the other clamping jaw. While, in this state, the first or second plate cylinder 11 or 12 is rotated at low speed, the image recorder 25 irradiates the surface of the plate mounted peripherally of the first or second plate cylinder 11 or 12 with a modulated laser beam for recording images thereon.

Figure 2A:
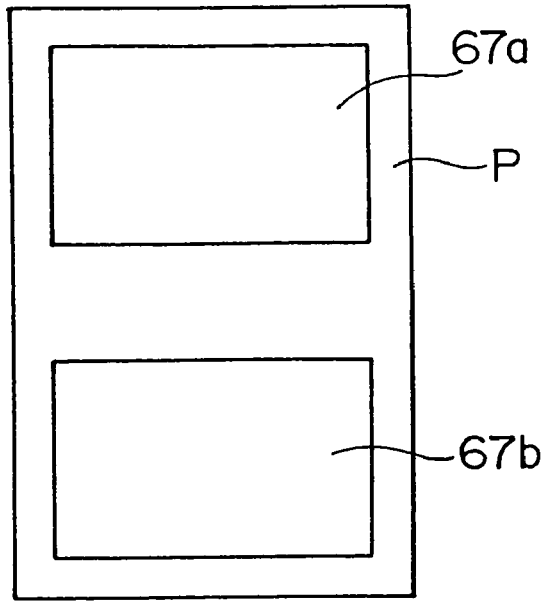
FIGS. 2A and 2B are explanatory views showing arrangements of image areas on printing plates.
Figure 2B:
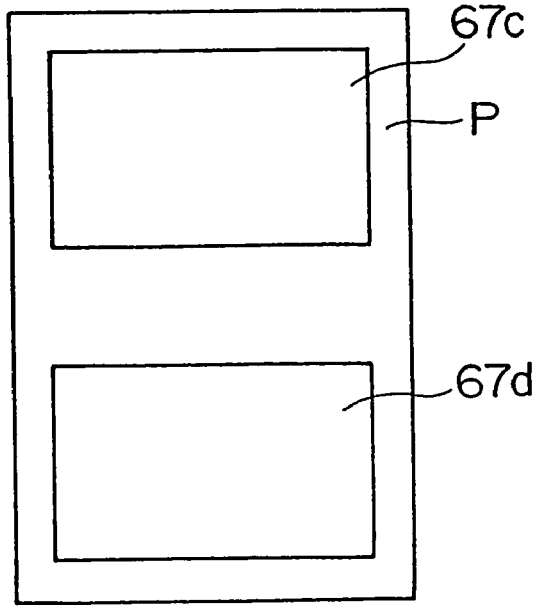

On the plate P mounted peripherally of the first plate cylinder 11, the image recorder 25, as shown in FIG. 2A, records an image area 67*a* to be printed with black ink, and an image area 67*b* to be printed with magenta ink. On the plate P mounted peripherally of the second plate cylinder 12, the image recorder 25, as shown in FIG. 2B, records an image area 67*c* to be printed with cyan ink, and an image area 67*d* to be printed with yellow ink. The image areas 67*a* and 67*b* are recorded in evenly separated positions, i.e. in positions separated from each other by 180 degrees, on the plate P mounted peripherally of the first plate cylinder 11. Similarly, the image areas 67*c* and 67*d* are recorded in evenly separated positions, i.e. in positions separated from each other by 180 degrees, on the plate P mounted peripherally of the second plate cylinder 12.

Referring again to FIG. 1, the ink feeders 20*a* and 20*b* are arranged around the first plate cylinder 11 in the first printing position, while the ink feeders 20*c* and 20*d* are arranged around the second plate cylinder 12 in the second printing position, as described hereinbefore. Each of these ink feeders 20*a*, 20*b*, 20*c* and 20*d* (which may be referred to collectively as "ink feeders 20") includes a plurality of ink rollers 71 and an ink source 72.

The ink rollers 71 of the ink feeders 20*a* and 20*b* are swingable by action of cams or the like not shown. With the swinging movement, the ink rollers 71 of the ink feeder 20*a* or 20*b* come into contact with one of the two image areas 67*a* and 67*b* formed on the plate P mounted peripherally of the first plate cylinder 11. Thus, the ink is fed only to an intended one of the image areas 67*a* and 67*b*. Similarly, the ink rollers 71 of the ink feeders 20*c* and 20*d* are swingable by action of cams or the like not shown. With the swinging movement, the ink rollers 71 of the ink feeder 20*c* or 20*d* come into contact with one of the two image areas 67*c* and 67*d* formed on the plate P mounted peripherally of the second plate cylinder 12. Thus, the ink is fed only to an intended one of the image areas 67*c* and 67*d*.

Figure 3:
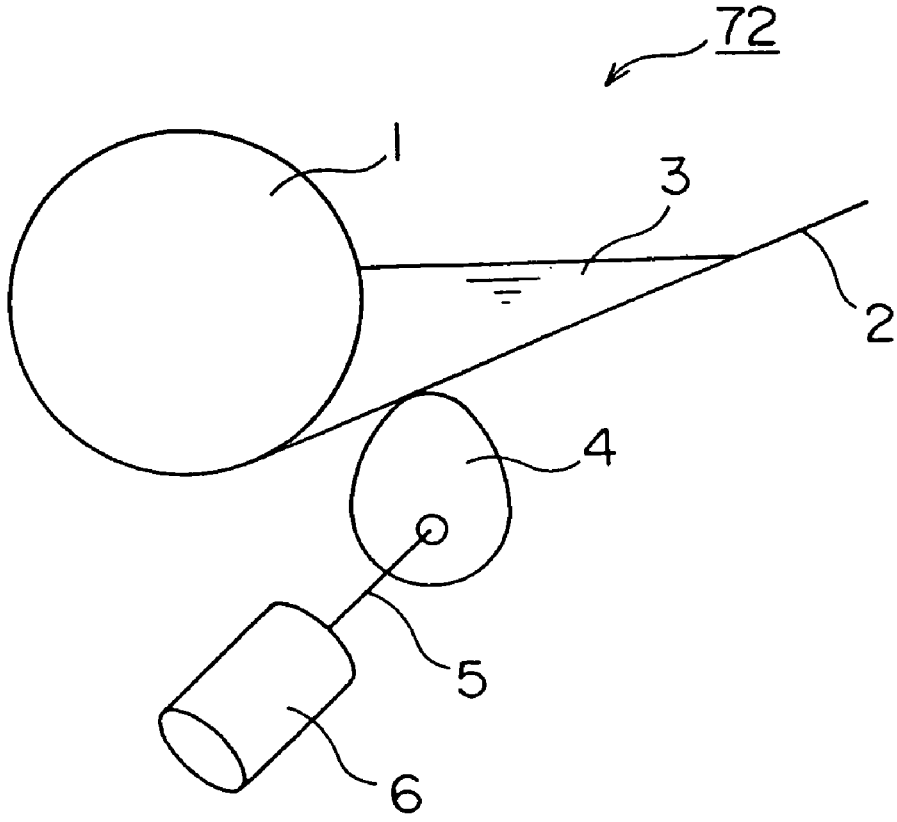
FIG. 3 is a schematic side view of an ink source in the printing machine according to this invention.
Figure 4:
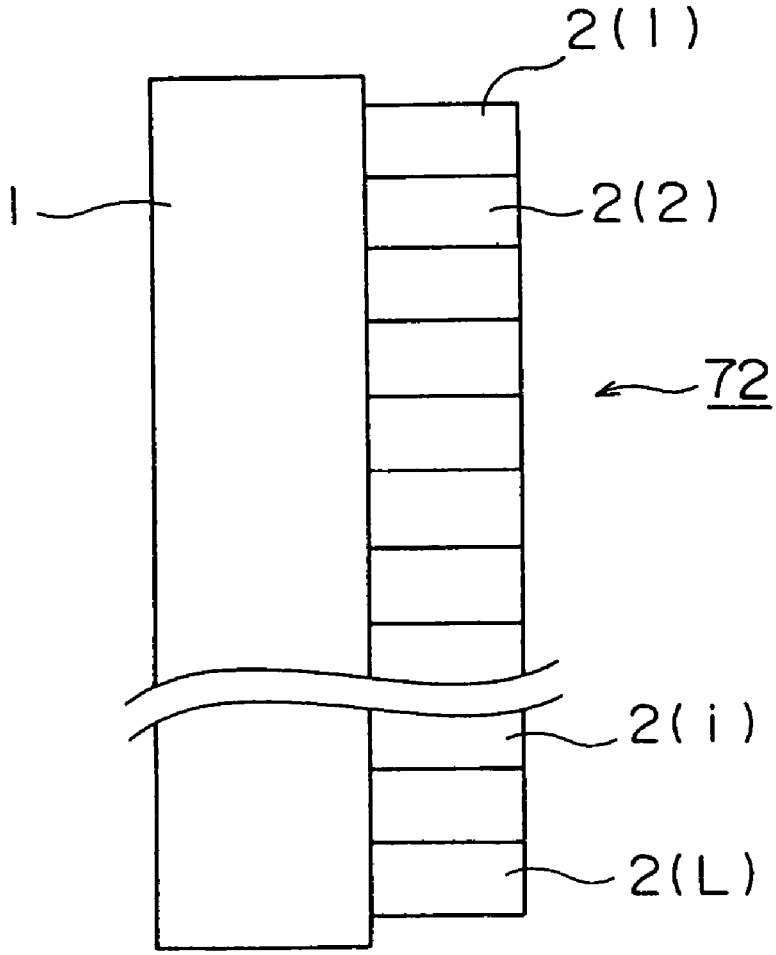
FIG. 4 is a plan view of the ink source.

FIG. 3 is a schematic side view of the ink source 72 noted above. FIG. 4 is a plan view thereof. Ink 3 is omitted from FIG. 4.

The ink source 72 includes an ink fountain roller 1 having an axis thereof extending in a direction of width of printing paper (i.e. perpendicular to a printing direction of the printing machine), and ink keys 2(1), 2(2) . . . 2(L) arranged in the direction of width of the printing paper. In this specification, these ink keys may be collectively called "ink keys 2". The ink keys 2 correspond in number to the number L of areas divided in the direction of width of the printing paper. Each of the ink keys 2 has an adjustable opening degree with respect to the outer periphery of the ink fountain roller 1. The ink fountain roller 1 and ink keys 2 define an ink well for storing ink 3.

Eccentric cams 4, L in number, are arranged under the respective ink keys 2 for pressing the ink keys 2 toward the surface of ink fountain roller 1 to vary the opening degree of each ink key 2 with respect to the ink fountain roller 1. The eccentric cams 4 are connected through shafts to pulse motors 6, L in number, for rotating the eccentric cams 4, respectively.

Each pulse motor 6, in response to an ink key drive pulse applied thereto, rotates the eccentric cam 4 about the shaft 5 to vary a pressure applied to the ink key 2. The opening degree of the ink key 2 with respect to the ink fountain roller 1 is thereby varied to vary the rate of ink fed to the printing plate.

Referring again to FIG. 1, the dampening water feeders 21*a*, 21*b*, 21*c* and 21*d* (which may be referred to collectively as "dampening water feeders 21") feed dampening water to the plates P before the ink feeders 20 feed the inks thereto. Of the dampening water feeders 21, the water feeder 21*a* feeds dampening water to the image area 67*a* on the plate P, the water feeder 21*b* feeds dampening water to the image area 67*b* on the plate P, the water feeder 21*c* feeds dampening water to the image area 67*c* on the plate P, and the water feeder 21*d* feeds dampening water to the image area 67*d* on the plate P.

Figure 5:
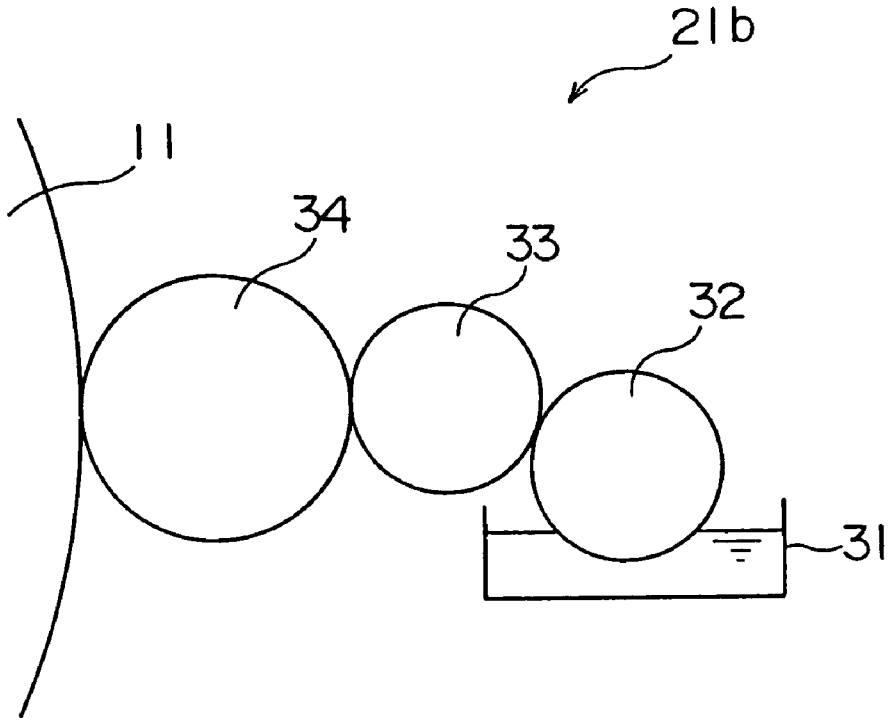
FIG. 5 is a schematic side view of a dampening water feeder in the printing machine according to this invention.

FIG. 5 is a schematic side view of the dampening water feeder 21*b*.

The dampening water feeder 21*b* includes a water source having a water vessel 31 for storing dampening water and a water fountain roller 32 rotatable by a motor, not shown, and two water rollers 33 and 34 for transferring dampening water from the fountain roller 32 to the surface of the plate mounted peripherally of the first plate cylinder 11. This dampening water feeder is capable of adjusting the rate of feeding dampening water to the surface of the plate by varying the rotating rate of fountain roller 32.

The three other water feeders 21*a*, 21*c* and 21*d* have the same construction as the water feeder 21*b*.

Referring again to FIG. 1, the developing device 26 is disposed under the first plate cylinder 11 or second plate cylinder 12 in the image recording position. This developing device 26 includes a developing unit, a fixing unit and a squeezing unit, which are vertically movable between a standby position shown in two-dot chain lines and a developing position shown in solid lines in FIG. 1.

In developing the images recorded on the plate P by the image recorder 25, the developing unit 26, fixing unit and squeezing unit are successively brought into contact with the plate P rotated with the first or second plate cylinder 11 or 12.

The first and second blanket cylinders 13 and 14 movable into contact with the first and second plate cylinders 11 and 12 have the same diameter as the first and second plate cylinders 11 and 12, and have ink transfer blankets mounted peripherally thereof. Each of the first and second blanket cylinders 13 and 14 is movable into and out of contact with the first or second plate cylinder 11 or 12 and the impression cylinder 15 by a contact mechanism not shown.

The blanket cleaning unit 29 disposed between the first and second blanket cylinders 13 and 14 cleans the surfaces of the first and second blanket cylinders 13 and 14 by feeding a cleaning solution to an elongate cleaning cloth extending from a delivery roll to a take-up roll through a plurality of pressure rollers, and sliding the cleaning cloth in contact with the first and second blanket cylinders 13 and 14.

The impression cylinder 15 contactable by the first and second blanket cylinders 13 and 14 has half the diameter of the first and second plate cylinders 11 and 12 and the first and second blanket cylinders 13 and 14, as noted hereinbefore. Further, the impression cylinder 15 has a gripper, not shown, for holding and transporting the forward end of printing paper.

The paper feed cylinder 16 disposed adjacent the impression cylinder 15 has the same diameter as the impression cylinder 15. The paper feed cylinder 16 has a gripper, not shown, for holding and transporting the forward end of each sheet of printing paper fed from the paper storage 27 by a reciprocating suction board 74. When the printing paper is transferred from the feed cylinder 16 to the impression cylinder 15, the gripper of the impression cylinder 15 holds the forward end of the printing paper which has been held by the gripper of the feed cylinder 16.

The paper discharge cylinder 17 disposed adjacent the impression cylinder 15 has the same diameter as the impression cylinder 15. The discharge cylinder 17 has a pair of chains 19 wound around opposite ends thereof. The chains 19 are interconnected by coupling members, not shown, having a plurality of grippers 41 arranged thereon. When the impression cylinder 15 transfers the printing paper to the discharge cylinder 17, one of the grippers 41 of the discharge cylinder 17 holds the forward end of the printing paper having been held by the gripper of the impression cylinder 15. With movement of the chains 19, ultraviolet-curable varnish is sprayed from the droplet spray nozzle head 50 onto the printing paper. Thereafter the printing paper is irradiated with ultraviolet light from the ultraviolet light emitting device 51 disposed downstream of the droplet spray nozzle head 50 with respect to the direction of transport toward the paper discharge station 28. Then, color densities of the detecting patches printed on the printing paper are measured by the image pickup device 40. Thereafter the printing paper is transported to the paper discharge station 28 to be discharged thereon.

The paper feed cylinder 16 is connected to a drive motor through a belt not shown. The paper feed cylinder 16, impression cylinder 15, paper discharge cylinder 17 and the first and second blanket cylinders 13 and 14 are coupled to one another by gears mounted on end portions thereof, respectively. Further, the first and second blanket cylinders 13 and 14 are coupled to the first and second plate cylinders 11 and 12 in the first and second printing positions, respectively, by gears mounted on end portions thereof. Thus, a motor, not shown, is operable to rotate the paper feed cylinder 16, impression cylinder 15, paper discharge cylinder 17, the first and second blanket cylinders 13 and 14 and the first and second plate cylinders 11 and 12 synchronously with one another.

Figure 6:
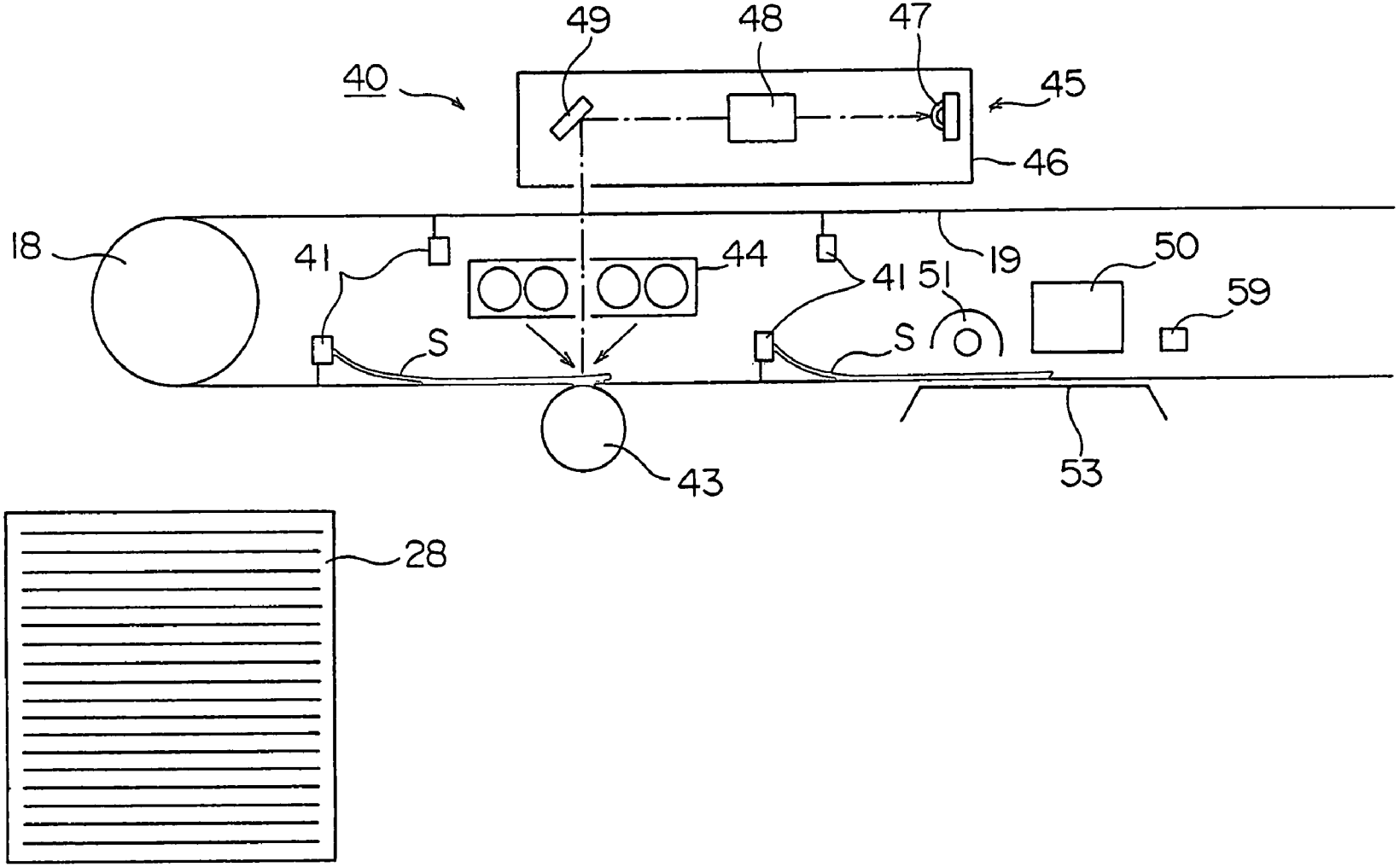
FIG. 6 is a schematic side view of a droplet spraying device and an ultraviolet light emitting device shown with an image pickup device.

FIG. 6 is a schematic side view of the droplet spray nozzle head 50 and ultraviolet light emitting device 51 shown with the image pickup device 40 for measuring color densities of the detecting patches printed on the printing paper.

The pair of chains 19 are endlessly wound around the opposite ends of the paper discharge cylinder 17 shown in FIG. 1 and a pair of large sprockets 18. As noted hereinbefore, the chains 19 are interconnected by coupling members, not shown, having a plurality of grippers 41 arranged thereon each for gripping a forward end of printing paper S transported.

The pair of chains 19 have a length corresponding to a multiple of the circumference of paper discharge cylinder 17. The grippers 41 are arranged on the chains 19 at intervals each corresponding to the circumference of paper discharge cylinder 17. Each gripper 41 is opened and closed by a cam mechanism, not shown, synchronously with the gripper on the paper discharge cylinder 17. Thus, each gripper 41 receives printing paper S from the paper discharge cylinder 17, transports the printing paper S with rotation of the chains 19, and discharges the paper S to the paper discharge station 28.

The printing paper S is transported with only the forward end thereof held by one of the grippers 41, the rear end of printing paper S not being fixed. Consequently, the printing paper S could flap during transport, which impairs operations, to be described hereinafter, of the droplet spray nozzle head 50 to apply varnish, of the ultraviolet light emitting device 51 to cure the varnish, and of the image pickup device 40 to measure densities of the detecting patches. To avoid such an inconvenience, this printing machine provides a suction roller 43 and a guide board 53, to be described hereinafter, disposed upstream of the paper discharge station 28 for stabilizing the printing paper S transported.

The guide board 53 is in the form of a planar board having a surface defining numerous minute suction bores connected to a vacuum pump not shown. The suction roller 43 is in the form of a hollow roller having a surface defining numerous minute suction bores, with the hollow interior thereof connected to the vacuum pump not shown. The guide board 53 and suction roller 43 are disposed to have a plane and an axis thereof, respectively, extending parallel to the grippers 41 bridging the pair of chains 19. The plane of the guide board 53 and a top portion of the suction roller 43 are substantially at the same height as a lower run of the chains 19.

The suction roller 43 is driven to rotate or freely rotatable in a matching relationship with a moving speed of the grippers 41. Thus, the printing paper S is drawn to the surface of the suction roller 43, thereby being held against flapping when passing over the suction roller 43. In place of the suction roller 43, a suction plate may be used to suck the printing paper S two-dimensionally as does the guide board 53.

The droplet spray nozzle head 50 is provided for spraying ultraviolet-curable varnish as a coating material to the printing paper S transported toward the paper discharge station 28. The ultraviolet light emitting device 51 is provided for curing the ultraviolet-curable varnish on the printing paper S by emitting ultraviolet light to the varnish. The varnish is applied to the printing paper S in order to protect and give luster to the surface of printing paper S. The constructions of the droplet spray nozzle head 50 and ultraviolet light emitting device 51 will be described in detail hereinafter.

The image pickup device 40 includes an illuminating unit 44 for illuminating the printing paper S transported, and an image pickup unit 45 for picking up images of the detecting patches on the printing paper S illuminated by the illuminating unit 44 and measuring color densities of the patches. The illuminating unit 44 is disposed between the upper and lower runs of chains 19 to extend along the suction roller 43, and has a plurality of linear light sources for illuminating the printing paper S over the suction roller 43.

The image pickup unit 45 includes a light-shielding and dustproof case 46, and a mirror 49, a lens 48 and a CCD line sensor 47 arranged inside the case 46. The image pickup unit 45 picks up the image of printing paper S over the suction roller 43 through slits of the illuminating unit 44. Incident light of the image reflected by the mirror 49 passes through the lens 48 to be received by the CCD line sensor 47. Image data obtained by the image pickup unit 45 is put to an image processing by a microcomputer not shown, to determine color densities of the detecting patches. Such a microcomputer may be used also as a controller 140 described hereinafter.

Figure 7:
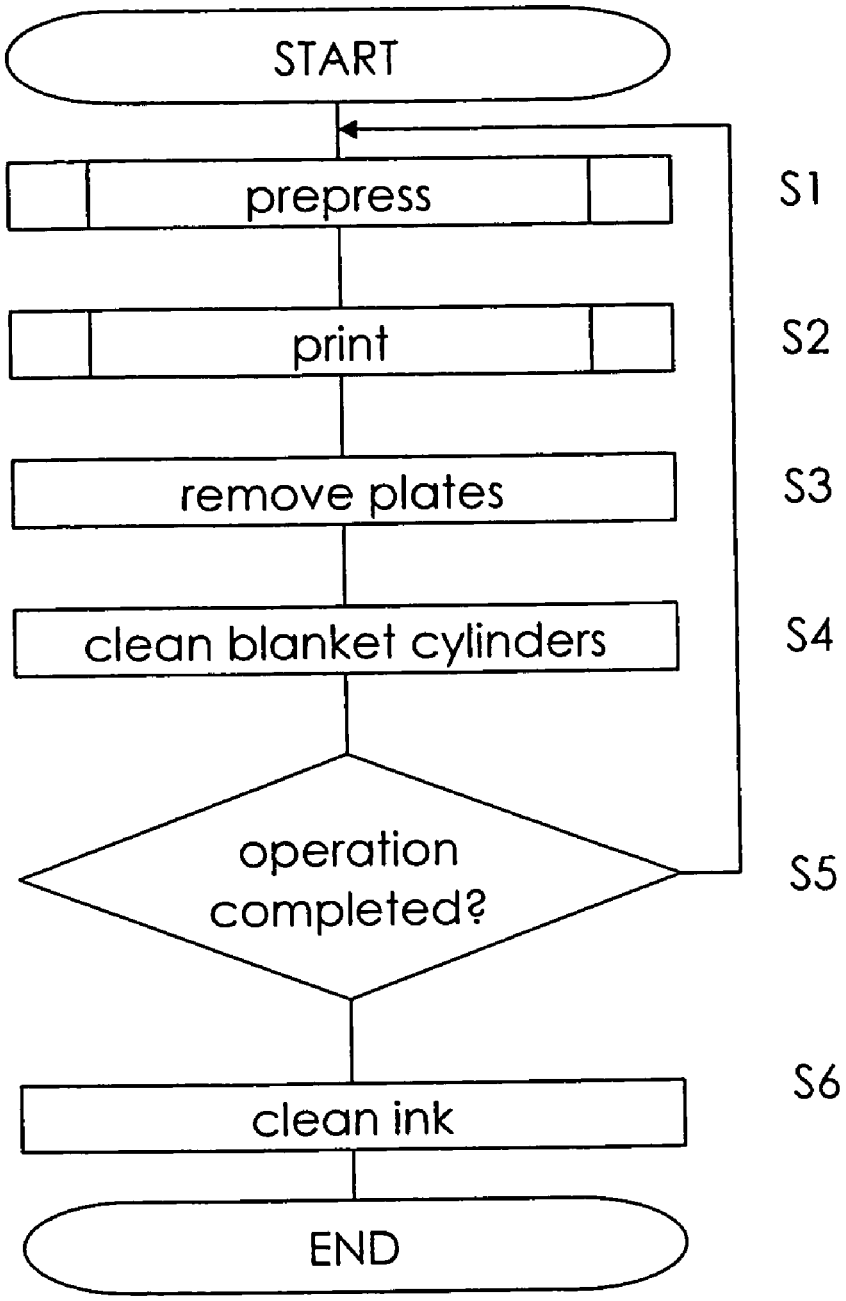
FIG. 7 is a flow chart of prepress and printing operations of the printing machine.

Prepress and printing operations of the printing machine will be described next. FIG. 7 is a flow chart showing an outline of the prepress and printing operations of the printing machine. These prepress and printing operations are directed to multicolor printing of printing paper S with the four color inks of yellow, magenta, cyan and black.

Figure 8:
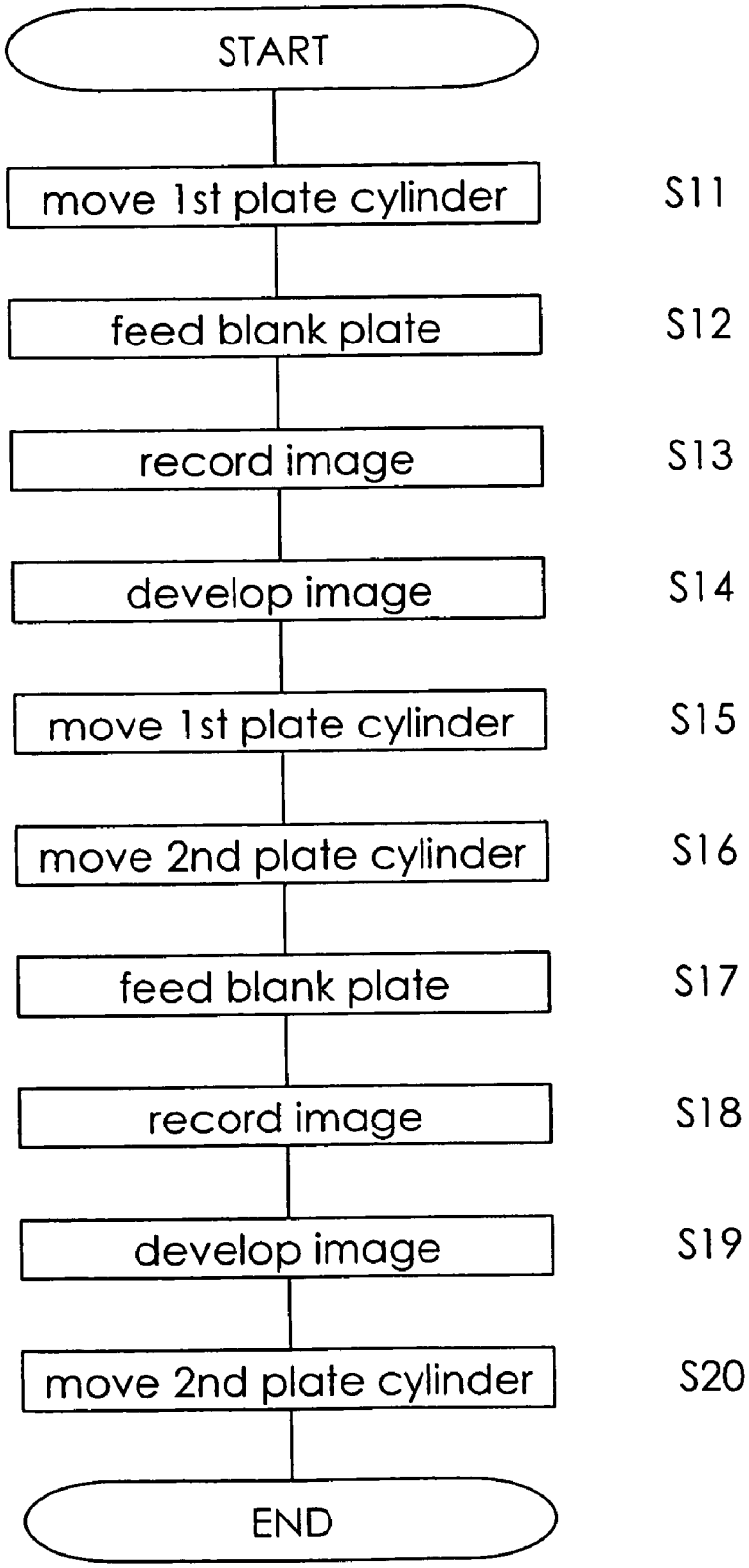
FIG. 8 is a flow chart of a prepress process according to this invention.

First, the printing machine executes a prepress process for recording and developing images on the plates P mounted on the first and second plate cylinders 11 and 12 (step S1). This prepress process follows the steps constituting a subroutine as shown in the flow chart of FIG. 8.

The first plate cylinder 11 is first moved to the image recording position shown in the two-dot chain line in FIG. 1. (step S11).

Next, a plate P is fed to the outer periphery of the first plate cylinder 11 (step S12). To achieve the feeding of the plate P, the pair of clamping jaws, not shown, clamp the forward end of plate P drawn from the supply cassette 63, and the rear end of plate P cut by the cutter 66.

Then, an image is recorded on the plate P mounted peripherally of the first plate cylinder 11 (step S13). For recording the image, the image recorder 25 irradiates the plate P mounted peripherally of the first plate cylinder 11 with a modulated laser beam while the first plate cylinder 11 is rotated at low speed.

Next, the image recorded on the plate P is developed (step S14). The developing step is executed by raising the developing device 26 from the standby position shown in two-dot chain lines to the developing position shown in solid lines in FIG. 1 and thereafter successively moving the developing unit, fixing unit and squeezing unit into contact with the plate P rotating with the first plate cylinder 11.

Upon completion of the developing step, the first plate cylinder 11 is moved to the first printing position shown in the solid line in FIG. 1 (step S15).

Subsequently, the printing machine carries out an operation similar to steps S11 to S15 by way of a prepress process for the plate P mounted peripherally of the second plate cylinder 12 (steps S16 to S20). Completion of the prepress steps for the plates P mounted peripherally of the first and second plate cylinders 11 and 12 brings the prepress process to an end.

Referring again to FIG. 7, the prepress process is followed by a printing process for printing the printing paper S with the plates P mounted on the first and second plate cylinders 11 and 12 (step S2). This printing process is carried out as follows.

First, each dampening water feeder 21 and each ink feeder 20 are placed in contact with only a corresponding one of the image areas on the plates P mounted on the first and second plate cylinders 11 and 12. Consequently, dampening water and inks are fed to the image areas 67*a*, 67*b*, 67*c* and 67*d* from the corresponding water feeders 21 and ink feeders 20, respectively. These inks are transferred from the plates P to the corresponding regions of the first and second blanket cylinders 13 and 14, respectively.

Then, the printing paper S is fed to the paper feed cylinder 16. The printing paper S is subsequently passed from the paper feed cylinder 16 to the impression cylinder 15. The impression cylinder 15 continues to rotate in this state. Since the impression cylinder 15 has half the diameter of the first and second plate cylinders 11 and 12 and the first and second blanket cylinders 13 and 14, the black and cyan inks are transferred to the printing paper S wrapped around the impression cylinder 15 in its first rotation, and the magenta and yellow inks in its second rotation.

The forward end of the printing paper S printed in the four colors is passed from the impression cylinder 15 to the paper discharge cylinder 17. This printing paper S is transported by the pair of chains 19 toward the paper discharge station 28. In the course of transport, the droplet spray nozzle head 50 applies the ultraviolet-curable varnish to the printing paper S, and the ultraviolet light emitting device 51 cures the varnish. After the color densities of the detecting patches are measured by the image pickup device 40, the printing paper S is discharged to the paper discharge station 28.

Upon completion of the printing process, the plates P used in the printing are removed (step S3). To remove the plates P, the first plate cylinder 11 is first moved to the image recording position shown in the two-dot chain line in FIG. 1. Then, while the first plate cylinder 11 is rotated counterclockwise, the blade mechanism 73 separates an end of the plate P from the first plate cylinder 11. The plate P separated is guided by the conveyor mechanism 69 into the discharge cassette 68. After returning the first plate cylinder 11 to the first printing position, the second plate cylinder 12 is moved from the second printing position to the image recording position to undergo an operation similar to the above, thereby having the plate P removed from the second plate cylinder 12 for discharge into the discharge cassette 68.

Upon completion of the plate removing step, the first and second blanket cylinders 13 and 14 are cleaned by the blanket cleaning unit 29 (step S4).

After completing the cleaning of the first and second blanket cylinders 13 and 14, the printing machine determines whether or not a further image is to be printed (step S5). If a further printing operation is required, the machine repeats steps S1 to S4.

If the printing operation is ended, the printing machine cleans the inks (step S6). For cleaning the inks, an ink cleaning device, not shown, provided for each ink feeder 20 removes the ink adhering to the ink rollers 71 and ink source 72 of each ink feeder 20.

With completion of the ink cleaning step, the printing machine ends the entire process.

Figure 9:
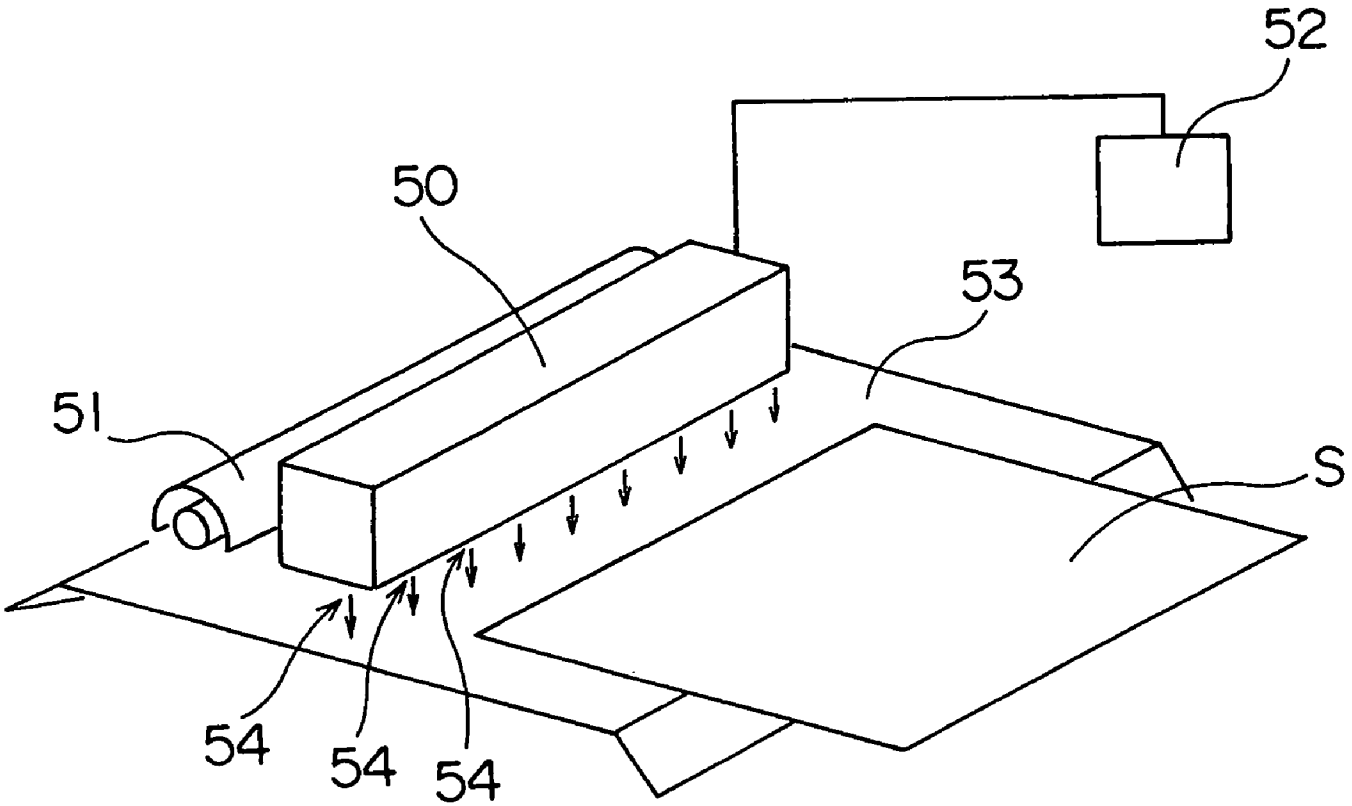
FIG. 9 is a perspective view showing a state of applying varnish to printing paper with a coating material applying apparatus according to this invention.

A coating material applying apparatus of this printing machine will be described next. FIG. 9 is a perspective view showing a state of applying varnish to the printing paper S with a coating material applying apparatus according to this invention. The coating material applying apparatus includes the guide board 53 for stabilizing transport of the printing paper S, the droplet spray nozzle head 50 for spraying the ultraviolet-curable varnish on the printing paper S, and the ultraviolet light emitting device 51 for emitting ultraviolet light to the ultraviolet-curable varnish sprayed on the printing paper S.

The guide board 53 has numerous minute suction bores formed in a surface thereof. These suction bores are connected to a vacuum pump not shown. Thus, when the printing paper S, with the forward end thereof held by a gripper 41, moves over the guide board 53, the printing paper S is drawn to the numerous minute bores against flapping. The guide board 53 may be a rotatable roller-like member similar to the suction roller 43. The printing paper S moves in this state to a position opposed to the droplet spray nozzle head 50. Then, droplet spray nozzles 54, described hereinafter, of the droplet spray nozzle head 50 spray the ultraviolet-curable varnish on the printing paper S.

The droplet spray nozzle head 50 is disposed opposite the guide board 53, and includes numerous droplet spray nozzles 54 arranged in a direction perpendicular to the direction in which the printing paper S is transported toward the paper discharge station 28. The droplet spray nozzle head 50 is disposed between the upper and lower runs of the chains 19. The droplet spray nozzle head 50, with the droplet spray nozzles 54, sprays the ultraviolet-curable varnish to the printing paper S transported toward the paper discharge station 28.

The droplet spray nozzle head 50 is connected through piping to a varnish tank unit 52 for storing the ultraviolet-curable varnish and feeding the varnish to the droplet spray nozzle head 50. The droplet spray nozzle head 50 has numerous droplet spray nozzles 54 as noted above, which are arranged equidistantly in the direction of width of the printing paper S. In response to a signal from the controller 140 described in detail hereinafter, the ultraviolet-curable varnish is allowed to flow from the varnish tank unit 52 into the droplet spray nozzle head 50. Selected nozzles 54 among the numerous droplet spray nozzles 54 spray the ultraviolet-curable varnish toward a particular portion of the printing paper S to be coated with the varnish, in the same way as the ink jet nozzles of an ink jet printer spray ink. The droplet spray nozzle head 50 in one embodiment, for example, has numerous resistors arranged in a corresponding relationship to the respective nozzles. When selected resistors are energized, bubbles are formed in the corresponding droplet spray nozzles 54 to pressurize the varnish in these droplet spray nozzles 54. Consequently, the selected droplet spray nozzles 54 spray droplets of the varnish onto the printing paper S.

A different droplet spraying mode may be employed such as by using piezoelectric elements.

The printing paper S with the ultraviolet-curable varnish applied thereto is transported to a position opposed to the ultraviolet light emitting device 51.

The ultraviolet light emitting device 51 is disposed adjacent the droplet spray nozzle head 50 and downstream thereof with respect to the direction of transport toward the paper discharge station 28, and is opposed to the guide board 53. The ultraviolet light emitting device 51 includes an ultraviolet lamp and a reflector extending transversely of the printing paper S transported. This ultraviolet light emitting device 51 emits ultraviolet light to the printing paper S with the ultraviolet-curable varnish applied thereto by the droplet spray nozzle head 50. As a result, the ultraviolet-curable varnish is cured and fixed to the printing paper S.

The apparatus may be simplified by arranging the ultraviolet light emitting device 51 adjacent the droplet spray nozzle head 50 as shown in FIG. 6. Further, the varnish may be dried (cured) almost simultaneously with application to the printing paper S. In an ordinary ink jet printing, special paper must be used to inhibit blurs. This embodiment, with the varnish cured immediately after application, does not require a particular type of paper, but may even use printing media other than paper (e.g. resin sheets, glass, and circuit boards). The ultraviolet light emitting device 51 is disposed between the upper and lower runs of the chains 19 as is the droplet spray nozzle head 50.

Figure 10:
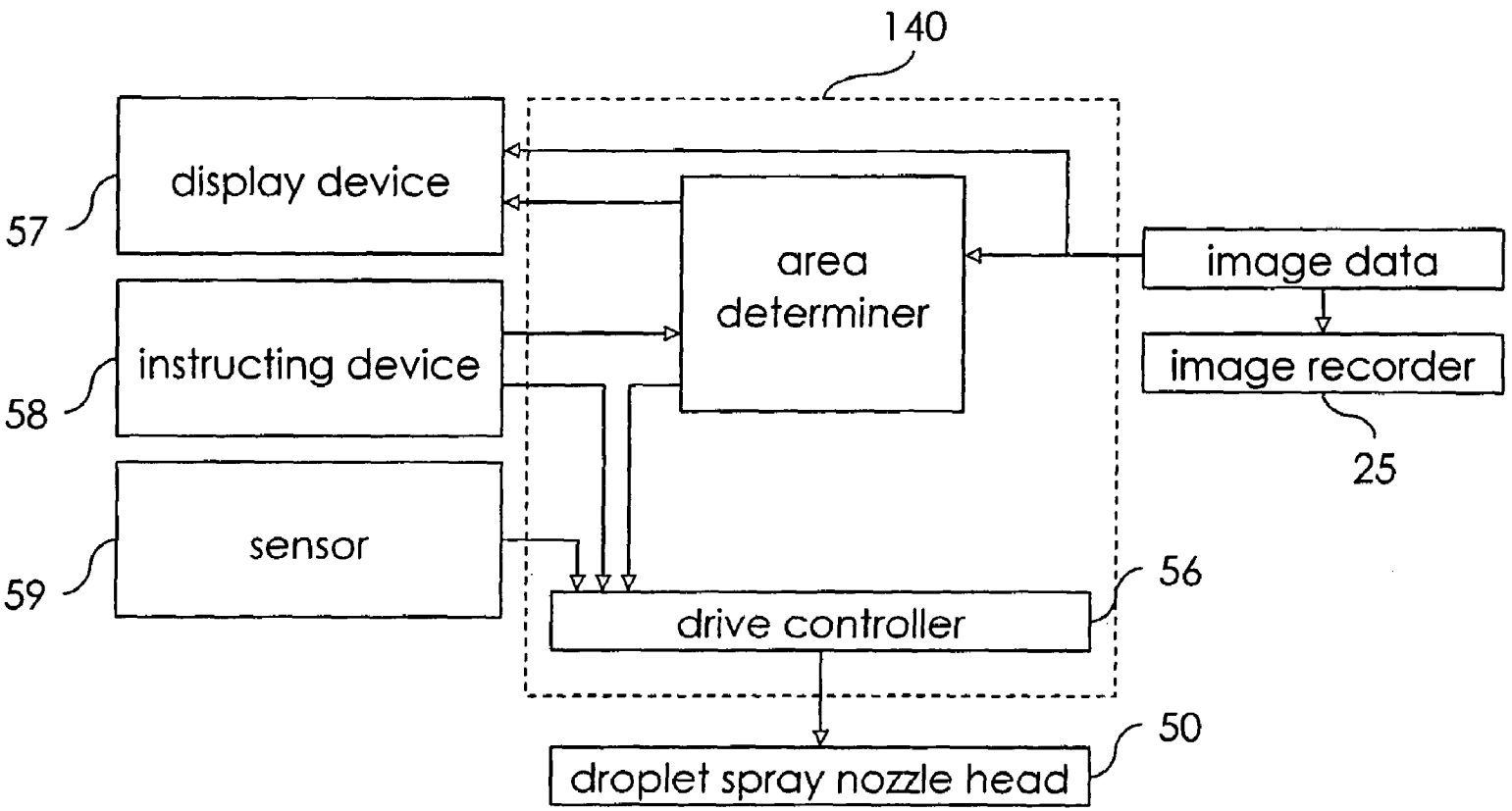
FIG. 10 is a block diagram of a controller for controlling a varnish applying operation of the coating material applying apparatus.
Figure 11:
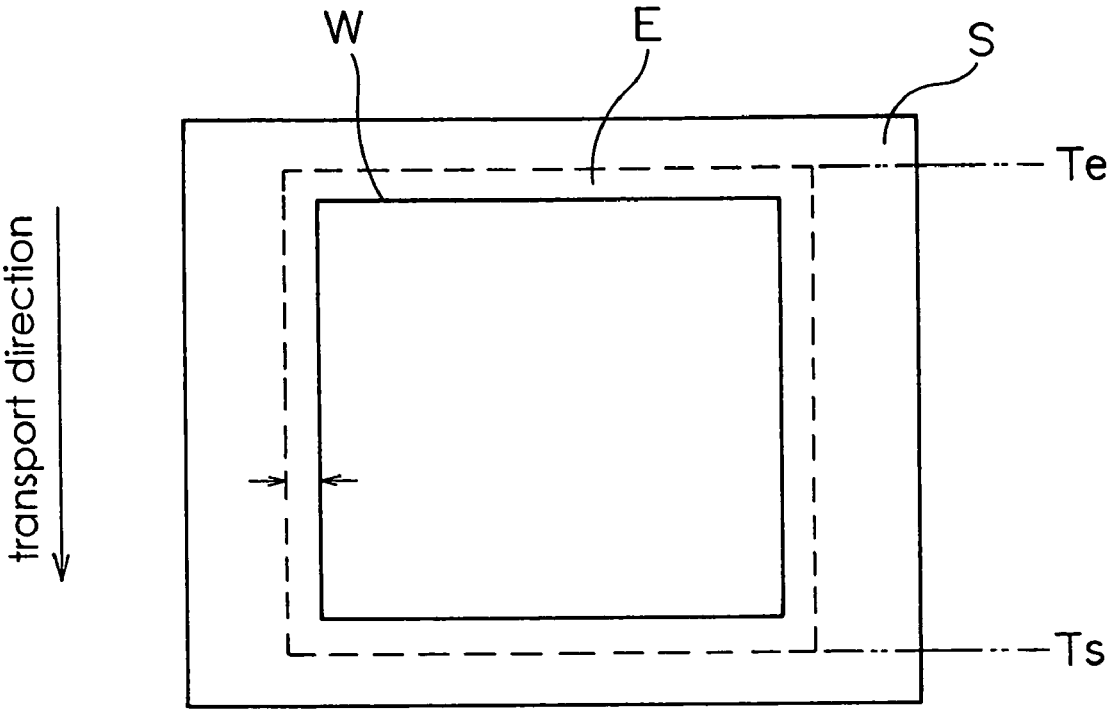
FIG. 11 is an explanatory view showing a particular area of printing paper printed by the printing machine according to this invention.
Figure 12:
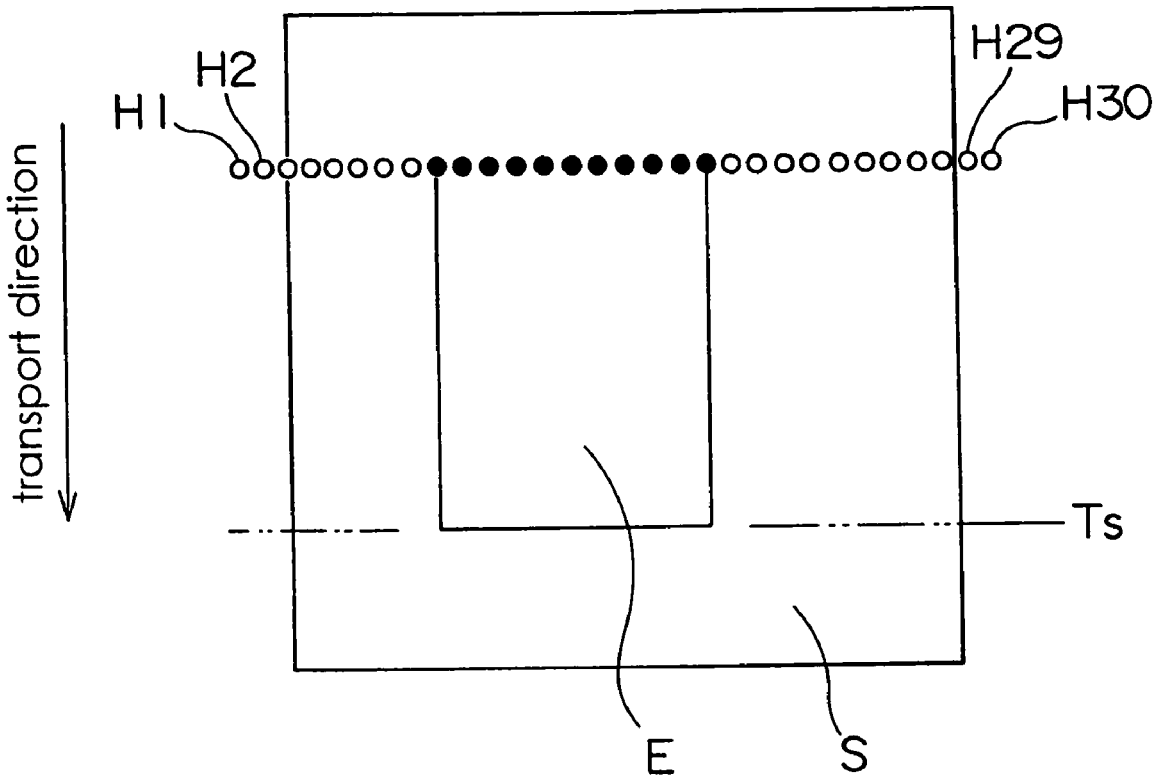
FIG. 12 is an explanatory view showing a state of selected droplet spray nozzles in the printing machine according to this invention spraying varnish to the particular area.

FIG. 10 is a block diagram of the controller 140 which controls the varnish applying operation of the coating material applying apparatus according to this invention. FIG. 11 is an explanatory view showing a particular area E of the printing paper S printed by the printing machine according to this invention. FIG. 12 is an explanatory view showing a state of selected droplet spray nozzles 54 spraying varnish on the particular area E.

To perform a printing operation, image data inputted to the printing machine from an image data processing terminal or the like at a preceding stage, not shown, is transmitted to the image recorder 25 as well as the controller 140 to be displayed on a display device 57 such as a monitor. The operator may, by using an instructing device 58 such as a keyboard and a mouse, set a particular area to be coated with varnish and coating conditions including a coating thickness, for example, based on the image data displayed on the display device 57. Conditions for the particular area E may be set by selecting an entire area on the printing paper S, an image-bearing area on the printing paper S or a predetermined area on the printing paper S, for example. Further, only an area of particular coordinates, only an area having a photo image, or only an area of characters in a particular color may, for example, be set as the particular area E. A condition for coating thickness may be set by selecting a thickness of varnish to be applied to the printing paper from a plurality of predetermined levels.

The particular area E set may be displayed on the display device 57 for confirmation by the operator. The particular area E may be divided into two or more areas. Furthermore, such a particular area E may also have various shapes such as rectangular, circular and polygonal. An outline W of an image designated by the operator may be extracted by a known image processing and, as shown in FIG. 11, the particular area E may be set according to this outline W.

The image data here is image data itself used for recording on the printing plates by the image recorder 25, or raw image data such as PPF (Print Production Format) data according to the CIP3 (International Cooperation for Integration of Prepress, Press and Postpress) standard.

Coating conditions for the particular area E set as described above are converted into control data by an area determiner 55 and transmitted to a drive controller 56 shown in FIG. 10. The varnish may be applied to the particular area E by energizing the resistors of droplet spray nozzles 54 corresponding to the particular area E among the droplet spray nozzles 54 corresponding to H1 through H30 shown in FIG. 12. The control data includes the numbers of the droplet spray nozzles 54 that spray the varnish, a start position Ts for starting spraying of the varnish on the printing paper S, and an end position Te for ending the spraying of the varnish on the printing paper S. Based on these data, the drive controller 56 carries out an on/off control of the resistors in the droplet spray nozzles 54.

The start position Ts for starting spraying of the varnish on the printing paper S, and the end position Te for ending the spraying of the varnish on the printing paper S, constitute information indicating a position of the printing paper S transported. Thus, this printing machine has, for example, an optical sensor 59 disposed upstream of the droplet spray nozzle head 50 with respect to the direction of transport from the paper storage 27, for detecting passage of the forward end of the printing paper S. A signal from this optical sensor 59 is transmitted to the drive controller 56. Thus, based on a transport speed of the printing paper S, this drive controller 56 can control the droplet spray nozzle head 50, so that selected droplet spray nozzles 54 spray the varnish as the particular area on the printing paper S passes through a position opposed to the droplet spray nozzles 54.

No problem arises even where the varnish is applied to the printing paper S in a relatively rough way as compared with the absolute accuracy of a printing position. It is therefore possible to use an encoder for detecting an angle of rotation of the impression cylinder 15, for example. In this case, a signal is transmitted from the encoder to the drive controller 56, and based on this signal, the drive controller 56 calculates a position of the printing paper S opposed to the droplet spray nozzles 54. The droplet spray nozzle head 50 may be controlled so that selected droplet spray nozzles 54 spray the varnish when the position calculated in this way coincides with the particular area on the printing paper S.

The coating condition set for a coating thickness is converted by the drive controller 56 into a signal for controlling energization of the resistors in the droplet spray nozzles 54. For example, the quantity (droplet size) of the varnish sprayed from the droplet spray nozzles 54 may be varied according to an amount of energization of the resistors. In this way, a coating thickness of the varnish applied to the printing paper S may be controlled.

The coating thickness may be controlled by varying the number of droplets instead of varying the droplet size of the varnish.

In the printing machine described above, the image data used in a varnish coating operation is the same as the image data for printing transmitted to the image recorder 25. Instead, image data may be prepared exclusively for the varnish coating operation. Such image data only for the varnish coating operation may be in the bitmap data format showing with one-bit values whether to apply the varnish or not, or may be vector data showing a particular area by means of a vector area.

The image data only for the varnish coating operation may be prepared as special color data for use.

The instructing device 58 has been described as being used by the operator in selecting conditions for a coating area and for a coating thickness. Alternatively, the operator may designate, by using a mouse, cursor or the like, a particular area of desired shape and range on the display device 57 displaying image data.

In this embodiment, the coating material applying apparatus is disposed between the upper and lower runs of the chains adjacent the paper discharge station. This apparatus may be disposed in any location downstream of the impression cylinder. Where, for example, the image pickup device 40 serves for acquiring a printed image itself rather than the detecting patches, it may be better to dispose the coating material applying apparatus downstream of the image pickup device 40.

Furthermore, a series of varnish coating operations may be performed by a stand-alone type coating material applying apparatus provided separately from the printing machine.

The above varnish coating operation may be implemented with various printing machines other than the printing machine according to the foregoing embodiment, such as a web press, intaglio printing machine, letterpress printing machine, mimeograph printing machine, screen printing machine, electrophotographic printing machine, and ink jet printing machine. However, use of a printing machine having a platemaking mechanism is advantageous since it has image data to be printed and allows the particular area E to be determined reliably by using this image data.

Instead of using the method of curing the ultraviolet-curable varnish with the ultraviolet light emitting device 51 as in the described embodiment, heat-curable varnish may be applied and cured by a heating device.

In the foregoing embodiment, prints are coated with varnish applied thereto. It is also possible to use a coating material other than varnish.

This invention may be embodied in other specific forms without departing from the spirit or essential attributes thereof and, accordingly, reference should be made to the appended claims, rather than to the foregoing specification, as indicating the scope of the invention.

This application claims priority benefit under 35 U.S.C. Section 119 of Japanese Patent Application No. 2003-107390 filed in the Japanese Patent Office on Apr. 11, 2003, the entire disclosure of which is incorporated herein by reference.

What is claimed is:

1. A coating material applying method for applying an image protecting coating material to a surface of a print, including the steps of:

applying said image protecting coating material to said surface of said print by spraying said image protecting coating material thereto from a plurality of droplet spray nozzles while said print is moved relatively to said droplet spray nozzles, said image protecting coating material being provided to protect an image on said print, wherein;

an area for image protecting coating material application is determined as a particular area on said print, said image protecting coating material being applied to said particular area by spraying said image protecting coating material selectively onto said particular area;

said plurality of droplet spray nozzles are arranged transversely of said print, said image protecting coating material being applied selectively to said particular area by spraying said image protecting coating material from selected droplet spray nozzles corresponding to said particular area among said plurality of droplet spray nozzles; and said particular area is determined based on image data forming said image on said print;

the method further including the steps of:

obtaining coating conditions for said particular area; and converting the obtained coating conditions into control data for said selected droplet nozzles.

2. The coating material applying method as defined in claim 1, wherein said image protecting coating material is an ultraviolet-curable coating material, said image protecting coating material being cured by emitting ultraviolet light to said print after applying said image protecting coating material to said print.

3. The method of claim 1, wherein the coating conditions comprise at least one of a droplet size and a number of droplets.

4. A coating material applying apparatus for applying an image protecting coating material to a surface of a print, comprising:

a plurality of droplet spray nozzles for spraying said image protecting coating material on said surface of said print to apply said image protecting coating material thereto, said image protecting coating material being provided to protect an image on said print;

moving means for moving said print relative to said droplet spray nozzles;

area determining means for determining an area for image protecting coating material application as a particular area on said print;

an instruction device for obtaining coating conditions for said particular area, wherein said area determining means is for converting said coating conditions into control data for said droplet spray nozzles; and control means for selectively driving, based on said control data, droplet spray nozzles corresponding to said particular area from among said plurality of droplet spray nozzles and causing said image protecting coating material to be sprayed from said droplet spray nozzles selected;

wherein said area determining means is arranged to determine said particular area based on image data forming said image on said print.

5. The coating material applying apparatus as defined in claim 4, wherein said image protecting coating material is an ultraviolet-curable coating material, said apparatus further comprising ultraviolet light emitting means for emitting ultraviolet light to said print after said droplet spray nozzles apply said image protecting coating material to said print.

6. The apparatus of claim 4, wherein the coating conditions comprise at least one of a droplet size and a number of droplets.

7. A printing machine for performing printing based on image data, comprising:

a transport mechanism for transporting a print;

coating applying means including a plurality of droplet spray nozzles arranged perpendicular to a direction in which said print is transported by said transport mechanism, for spraying an image protecting coating material on said print as said print is transported, said image protecting coating material being provided to protect an image on said print;

area determining means for determining, based on said image data, an area for image protecting coating material application as a particular area on said print;

an instruction device for obtaining coating conditions for said particular area, wherein said area determining means is for converting said coating conditions into control data for said droplet spray nozzles; and control means for selectively driving, based on said control data, droplet spray nozzles corresponding to said particular area from among said plurality of droplet spray nozzles, and causing said image protecting coating material to be sprayed from said droplet spray nozzles selected;

wherein said area determining means is arranged to recognize an image area on said print from said image data, and determine said particular area to coincide with said image area.

8. The printing machine as defined in claim 7, further composing:

platemaking means for making printing plates based on said image data; and printing means for performing printing by using said printing plates.

9. The printing machine as defined in claim 7, wherein said area determining means is arranged to determine said particular area as an area for image protecting coating material application on said print based on data inputted by an operator.

10. The printing machine as defined in claim 7, wherein said image protecting coating material is an ultraviolet-curable coating material, said printing machine further comprising ultraviolet light emitting means disposed downstream of said coating applying means with respect to said direction in which said print is transported, for emitting ultraviolet light to said print.

11. The apparatus of claim 7, wherein the coating conditions comprise at least one of a droplet size and a number of droplets.

* * * * *